US006943308B2

(12) United States Patent
Ravnkilde et al.

(10) Patent No.: US 6,943,308 B2
(45) Date of Patent: Sep. 13, 2005

(54) DIGITAL PULSE GENERATOR ASSEMBLY

(75) Inventors: Søren Ravnkilde, Ballerup (DK); Karsten Videbaek, Roskilde (DK)

(73) Assignee: Sonion Roskilde A/S, Rosklide (DK)

( * ) Notice: Subject to any disclaimer, the term of this patent is extended or adjusted under 35 U.S.C. 154(b) by 58 days.

(21) Appl. No.: 10/267,740

(22) Filed: Oct. 10, 2002

(65) Prior Publication Data

US 2003/0095584 A1 May 22, 2003

Related U.S. Application Data

(60) Provisional application No. 60/328,349, filed on Oct. 10, 2001.

(51) Int. Cl.[7] ..... H01H 29/16

(52) U.S. Cl. ..... 200/200; 200/11 R; 200/11 TW

(58) Field of Search ..... 200/11 R, 501, 200/11 DA, 252, 18, 400, 6, 52 R, 11 EA, 11 TW; 381/324, 312, 330

(56) References Cited

U.S. PATENT DOCUMENTS 4,801,814 A * 1/1989 Rose et al. ..... 307/106
5,128,661 A * 7/1992 Fowler ..... 345/184
5,194,704 A * 3/1993 Michalski et al. ..... 200/11 R
5,380,965 A 1/1995 Moller
5,418,341 A * 5/1995 Sato ..... 200/11 R
5,693,993 A * 12/1997 Ito et al. ..... 310/68 B
6,175,091 B1 * 1/2001 Nishimura et al. ..... 200/571
6,555,768 B2 * 4/2003 Deruginsky et al. ..... 200/4

FOREIGN PATENT DOCUMENTS

DK 168258 B 2/1994

* cited by examiner

*Primary Examiner*—K. Richard Lee
(74) *Attorney, Agent, or Firm*—Harness, Dickey & Pierce, PLC

(57) ABSTRACT

The present invention relates to a digital pulse generator being adapted to be integrated in electronic equipment, such as hearing instruments, mobile phones and/or audio equipment. In particular, the present invention relates to a digital pulse generator being capable of providing an output signal on two or more terminals. The digital pulse generator according to the present invention requires a minimum of electrical components, so as to provide a cheaper and easier assembling process, and to provide a digital pulse generator that is shock resistant.

23 Claims, 10 Drawing Sheets

DIGITAL PULSE GENERATOR ASSEMBLY

This application claims the benefit of provisional application No. 60/328,349, filed Oct. 10, 2001.

The present invention relates to a digital pulse generator assembly providing digital output signal.

BACKGROUND OF THE INVENTION

U.S. Pat. No. 5,380,965 (belonging to the same applicant) discloses an electromechanical pulse generator having a purely mechanical mode of operation for microelectronic equipment, e.g. volume control in hearing aids, consisting of a housing formed by a fixed base portion in which a shaft is fixedly mounted. A timing wheel is rotatably mounted around the shaft, the timing wheel having the form of a downward facing open cylinder and being fixedly connected to a casing which forms an external handle. The inner cylinder surface of the timing wheel is provided with grooves engaging with a protrusion of a circular carrier rotatably mounted around the shaft.

A U-shaped contact spring has members which are individually imparted an oscillating movement between contact pairs A-B-C and A-D-E, respectively, by the turn of the timing wheel in one or the other direction via the carrier which can only move over a pre-determined circular section, so as to generate digital pulse trains. A locking device prevents the carrier from moving beyond the pre-determined circular section and causes the protrusion to continuously engage with the grooves by the turn of the timing wheel.

SUMMARY OF THE INVENTION

It is an object of the present invention to provide a digital pulse generator to be integrated in electronic equipment, such as hearing instruments, mobile phones and/or audio equipment.

It is a further object of the present invention to provide a digital pulse generator that is able to provide an output signal on two or more terminals.

It is a further object of the present invention to provide a digital pulse generator having a minimum of electrical components, so as to provide a cheaper and easier assembling process.

It is a further object of the present invention to provide a digital pulse generator that is more shock resistant.

According to a first aspect, the present invention relates to a digital impulse generator assembly comprising;

a housing comprising a base part and a cover, at least a first, second and third external terminal, each protruding said base part and having a contact part inside said housing, the contact part of the first terminal being movable between a neutral position and a contact position where it is in electrical contact with the contact part of the second or third terminal, and a wheel comprising spaced positioned cams, each cam being adapted to engage and move the contact part of the first terminal from its neutral position to its contact position upon rotation of said wheel, and wherein an output signal is provided on the second or third terminal each time the contact part of the first terminal is in electrical contact with the contact part of the second or third terminal, respectively.

The digital signal may be read by e.g. a microprocessor, which typically will be an integrated part of any electronic equipment, such as hearing instruments, mobile phones, audio equipment, etc.

The assembly is able to provide a signal on two different terminals depending on the way of rotation of the wheel. Preferably, the cams move the contact part of the first terminal into contact with the contact part of the second terminal upon rotating the wheel clockwise, and moves the contact part of the first terminal into contact with the contact part of the third terminal upon rotating the wheel counter clock-wise.

The contact part of the terminals may be provided as a bent portion of the terminal, said contact part being able to return to its neutral position after each cam has slipped it (goes out of engagement with the contact part) upon rotation of said wheel. The bending strength is preferably so large that the contact part does not go into contact with the other contact parts by accident, but only by moving it with the cams. This high bending strength provide a much more shock resistant pulse generator that is less sensitive to external influence.

In a preferred embodiment, the wheel comprises a cylindrical hollowed wheel having spaced positioned cams provided circumferentially on its internal surface. Preferably, the base comprises a part having recesses for receiving and holding the contact part, the terminals protruding the base part through holes provided in its bottom end. The wheel may be positioned on the base part by sliding it down over the part comprising the recesses. The contact part of the first terminal may terminate in an inclined portion that is adapted to engage the cams of the wheel. Preferably, the contact parts of the terminals are elevated positioned in said base part, the contact part of the first terminal being positioned between the two other contact parts. Thus, the contact part of the first terminal is lifted up, due to the engagement between a cam and said inclined portion, into its contact position with the contact part above it, when the wheel is rotated e.g. clockwise. Oppositely, the contact surface of the first terminal is pushed down, due to the engagement between a cam and said inclined portion, into its contact position with the contact part below it. Thus, it is possible to provide an output signal on two different terminals depending on the direction of rotation of the wheel.

A user operable carrier wheel may be meshed with said wheel, so that an operator can rotate the wheel when rotating the carrier wheel, the carrier wheel having a user operable part protruding said cover.

The cover and base part together defines the housing that provides a shielding cavity for the wheel, carrier wheel and contact parts of the terminals. The connection between the cover and base part may be sealed with e.g. silicone or other sealing products so as to provide a water- and moisturetight housing. Also, the connection between the user operable part protruding the cover and the cover may be sealed.

The wheel may comprise recesses in its upper and/or lower edge for receiving projections of the carrier wheel, so as to mesh the carrier wheel with the wheel. By having recesses in both ends, the way of turning it during the assembling of the assembly does not matter. Thus, it makes to way of production easier and more effective.

The wheel may comprise two sets of cams, a first set positioned at a first level and a second set positioned at a second level on the internal surface of the cylindrical wheel. The distance between the cams of the first set being different from the distance between the cams of the second set. Thus, it is possible to provide different kind of output signals o on the terminals depending on which way the wheel is turned when assembling the assembly. In this case, it is of course of importance which way the wheel is turned during assembling.

In order to provide as precise and good contact between the contact parts, they may each comprise contact points (e.g. punched projections), so that the electrical contact between the respective contact parts is provided in one single point.

The assembly is preferably used in compact electronic instruments, where the space available is minimal. Preferably, the external diameter of the housing is equal to or less than 3 mm, such 2.55 mm.

The assembly may comprise further terminals, such as a fourth or fifth external terminal protruding said base part and having a contact part inside said housing. Thus, it is possible to take out further output signals for different controlling purposes.

The first terminal is preferably connected to an external power supply such as a battery. However, it can be connected to ground, while to other terminals are connected to a power supply.

According to a second aspect, the present invention relates to a digital impulse generator assembly comprising;

a housing comprising a base part and a cover, at least a first, second and third external terminal, each protruding said base part and having a contact surface inside said housing, a rotatable member providing discontinuous electrical contact between the contact surface of the first terminal and a contact surface of a contact member, said contact member providing contact between the contact surface of the second or third terminal and said rotatable member, a first rotatable carrier for carrying said contact member, a second rotatable carrier for carrying said rotatable member, wherein an output signal is provided on the second or third terminal each time the rotatable member provides contact between said first contact surface and the second or third contact surface, respectively, upon rotating said second carrier.

Preferably, the rotatable member comprises an encoder disc having a contact part that is in continuous electrical contact with the contact part of the first terminal, and a plurality of spaced positioned taps adapted to get in contact with the contact member.

Preferably, the contact member comprises a substantially U-shaped wedge mounted to the second carrier, the wedge comprising a contact point in each end. The contact member may be rotated from a first position, where it provides contact between the contact surfaces of the first and second terminal, to a second position, where it provides contact between the contact surfaces of the first and third terminal. Thus, it is possible to provide a signal on different terminals depending on which position the contact is placed in.

Preferably, the rotation of the contact member, so as to move it from said first position to said second position, is provided upon changing the direction of rotation of the second rotatable carrier. While rotating the second rotatable member in one direction, the first rotatable member will follow this rotation, as it is in engagement with the second rotatable member (e.g. by friction) until the contact member reaches its position, where it provides contact between the contact surfaces of e.g. the first and second terminal. The contact member will remains in this position as long as the second rotatable member is rotated in the same direction. When changing the direction of rotation of the second rotatable member, the first rotatable member will follow this rotation until the contact member reaches its position, where it provides contact between the contact surfaces of the first and third terminal.

Preferably, the base part comprises a stop member for stopping the rotation of the contact member, so as to only rotate it between said first and second position despite of a continuous rotation of said second rotatable member.

The terminals may comprise pins protruding the base part through holes and having a bent portion constituting its contact surface. The contact surface of one or more of the terminals may be provided by rivets riveted to the terminal (s), so as to provide a more precise point of contact.

The terminals may comprise conducting bars riveted to the base part, the riveted part of each terminal defining its contact surface.

The terminals may comprise flexible strips riveted to the base part, the rivet defining the contact surface of the terminal.

Preferably, the external diameter of the housing is equal to or less than 3 mm, such as 2.55 mm.

The assembly according to this second aspect may comprise further terminals, such as a fourth or fifth external terminal protruding said base part and having a contact part inside said housing.

The rotation of the rotatable members may be provided by a user operable member meshed with said second carrier so as to rotate the second carrier when rotating the carrier operable member, the operable member having a user operable part protruding said cover.

The assembly according to the first and second aspect may be used for or integrated in electronic equipment, such as hearing instruments (BTE, ITE or ITC), mobile phones, PDAs, game devices, and/or other audio equipment.

BRIEF DESCRIPTION OF THE DRAWINGS

Preferred embodiments of the invention will be described in details below with reference to the accompanying figures, wherein.

Figure 1:
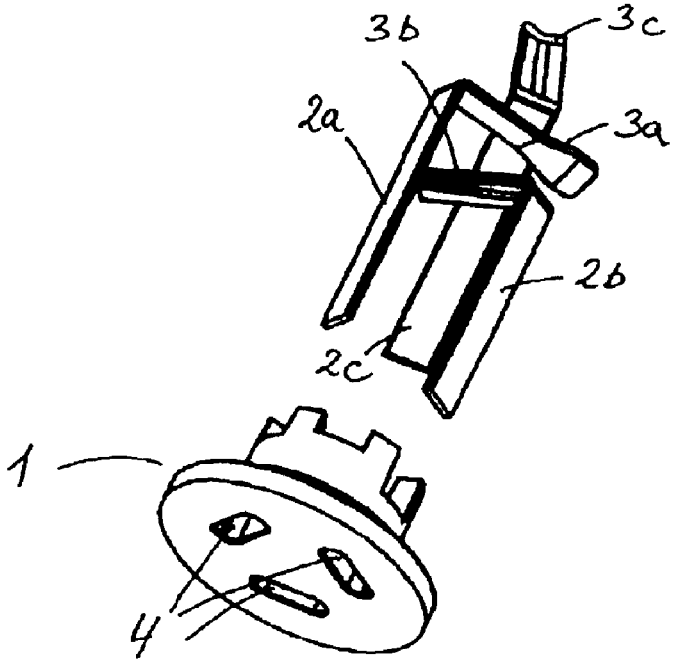
FIGS. 1–6 shows an assembly according the first aspect of the present invention.

While the invention is susceptible to various modifications and alternative forms, specific embodiments have been shown by way of example in the drawings and will be described in detail herein. It should be understood, however, that the invention is not intended to be limited to the particular forms disclosed. Thus, the invention is to cover all modifications, equivalents, and alternatives falling within the spirit and scope of the invention as defined by the appended claims.

DETAILED DESCRIPTION OF THE INVENTION

FIG. 1 shows a base part 1 of the assembly according to the first aspect of the present invention. The base part receives and holds three terminals (2*a*, 2*b*, 2*c*). Each terminal has a contact part (3*a*, 3*b*, 3*c*). The terminals protruding the base part 1 through the holes 4.

Figure 2:
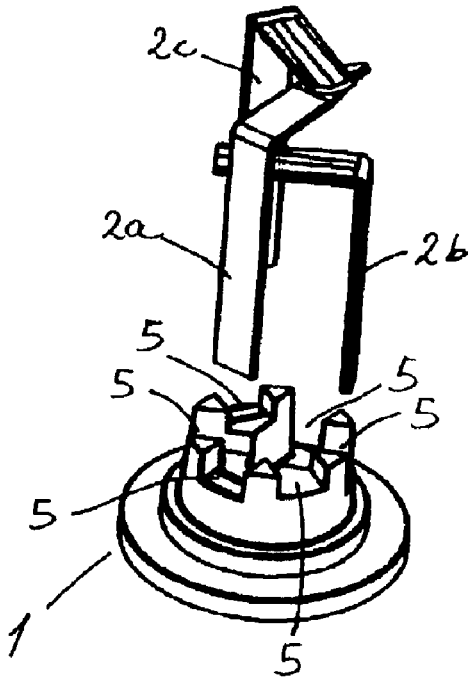

FIG. 2 shows the base part 1 having recesses 5 for receiving and holding the contact parts (3*a*, 3*b*, 3*c*) of the terminals (2*a*, 2*b*, 2*c*).

Figure 3:
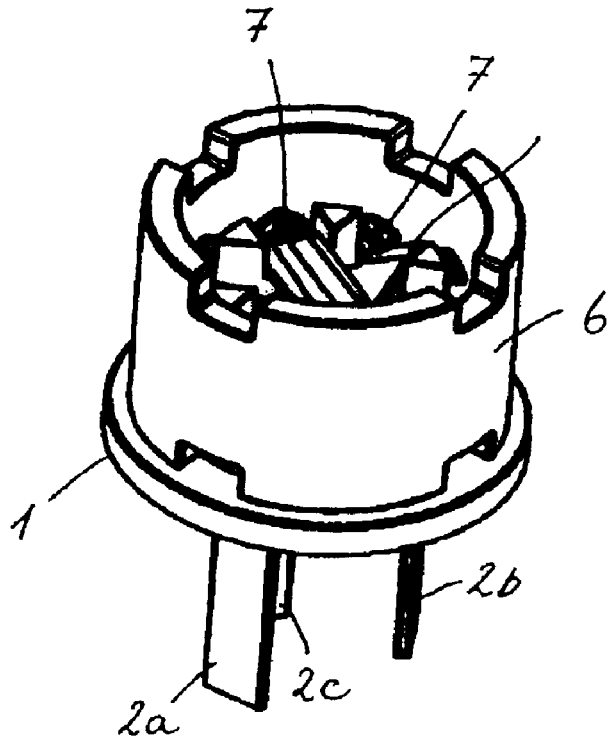
Figure 4:
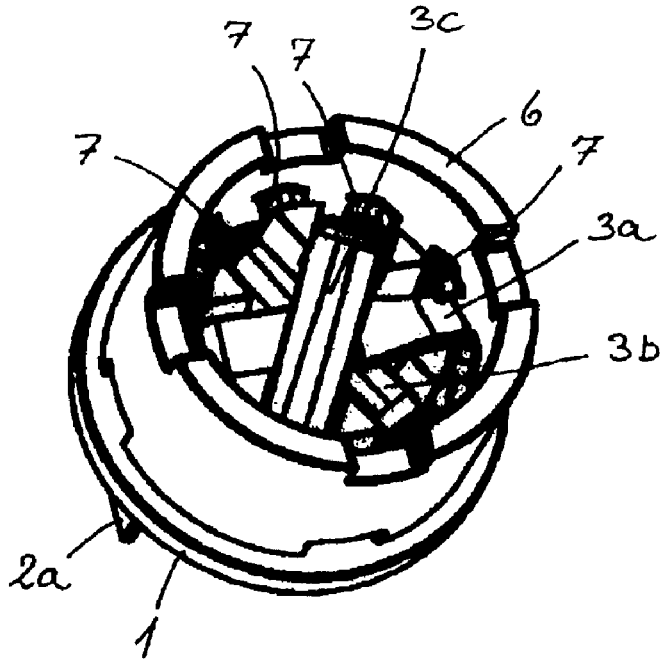

FIGS. 3 and 4 show the wheel 6 mounted on the base part 1, so that the cams 7 on the internal surface of the wheel engage the contact part 3*a* of the terminal 2*a*. If the wheel 6 is rotated clock-wise, each cam 7 pushes down the contact part 3*a* into contact with contact part 3*b*, as the contact part 3*a* comprises an inclined end portion that is grabbed by the cam. If the wheel 6 is rotated counter clock-wise, each cam 7 lifts up the contact part 3*a* into contact with contact part 3*c*. The contact part 3*a* returns to its neutral position, where it is not in contact with any of the other contact parts, after each cam slips it. Thus, an output signal is provided on the terminal 2*b* or 2*c* (depending on the direction of rotation) each time contact is provided.

Figure 5:
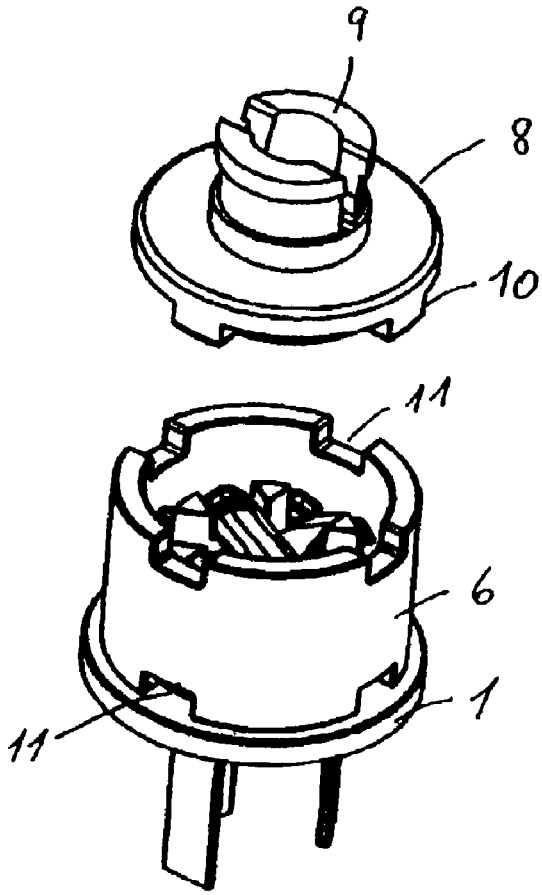
Figure 6:
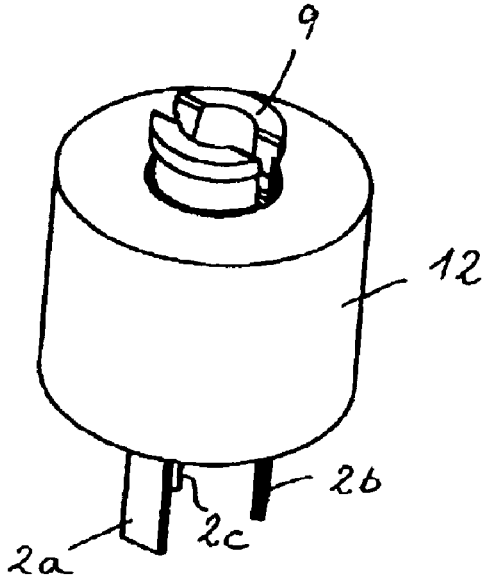

FIG. 5 shows a carrier wheel 8 to mesh with the wheel 6. The carrier wheel 8 comprises a user operable part 9 that protrudes the cover of the assembly (as seen in FIG. 6). The carrier wheel comprises projections 10 that engage with recesses 11 on the wheel 6. The wheel 6 comprises recesses 11 in both the upper and lower edge, so it does not matter which way the wheel 6 is turned during assembling of the assembly. FIG. 6 shows the final assembly, where a cover 12 is attached to the base part 1, and thus forming a shielding cavity for the contact parts, the wheel 6, and the carrier wheel 8.

Figure 7:
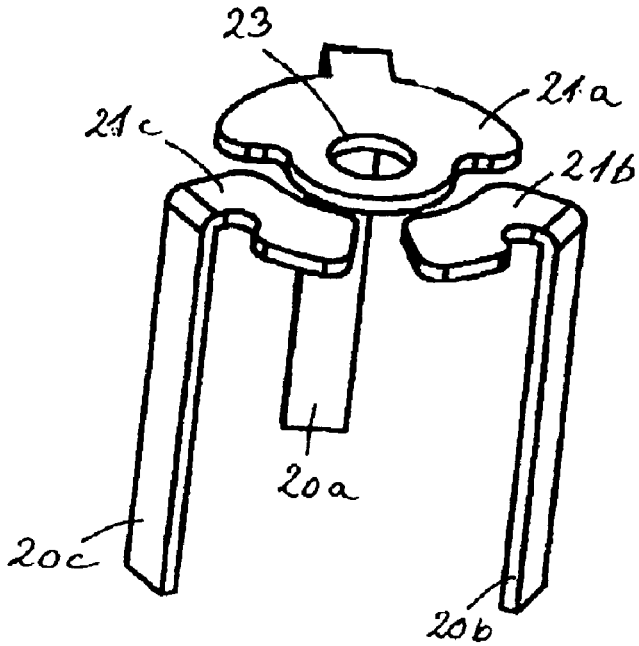
FIGS. 7–16 shows a first embodiment of the assembly according to the second aspect of the present invention.
Figure 8:
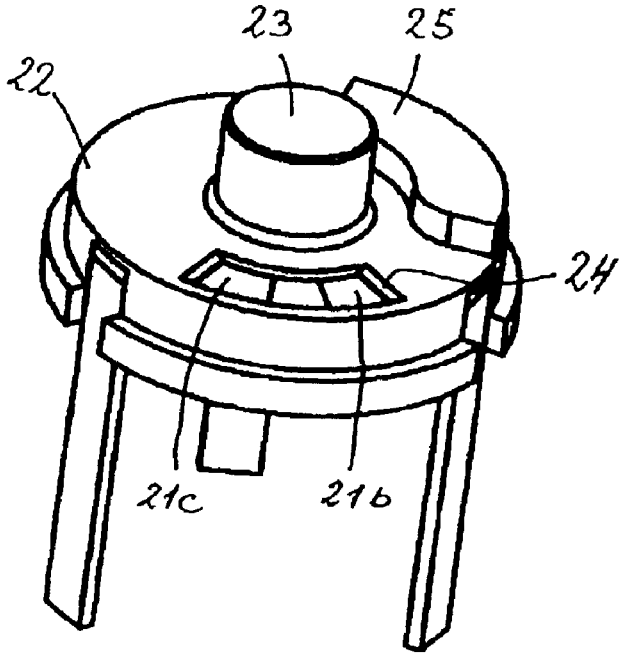

FIG. 7 shows three terminals 20*a*, 20*b*, 20*c* of an assembly according to the second aspect. The terminals each comprises a contact part 21*a*, 21*b*, 21*c*. The contact part 21*a* comprises a hole 22 in which a rivet 23 is to be mounted, the rivet constituting the contact surface of the terminal 20*a*. In FIG. 8, the three terminals are mounted in a base part 22 comprising a hole 24 for making the contact parts 21*b*, 21*c* accessible. The base part further comprises a stopping member 25 for stopping the rotation of a first rotatable carrier (see FIG. 11).

Figure 9:
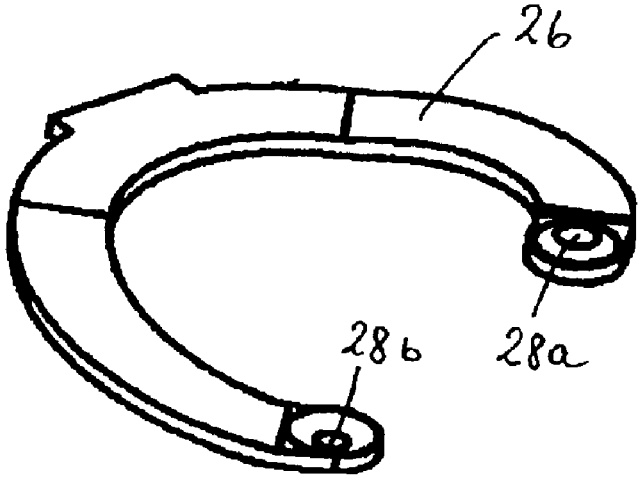
Figure 10:
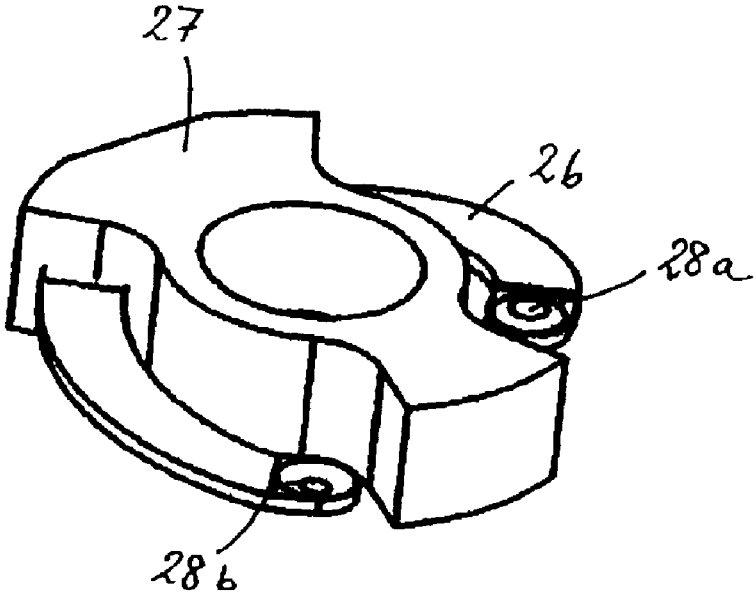

FIGS. 9 and 10 show the contact member 26 and the first rotatable carrier member 27 for rotating the contact member. The contact member 26 comprises a U-shaped conducting wedge (wiper) that provides the electrical contact between the encoder disc (see FIGS. 12–14) and the contact part 21*b* or 21*c*. The wedge 26 comprises contact points 28*a*, 28*b* in each end, so as to provide as precise and well-defined contact point as possible.

Figure 11:
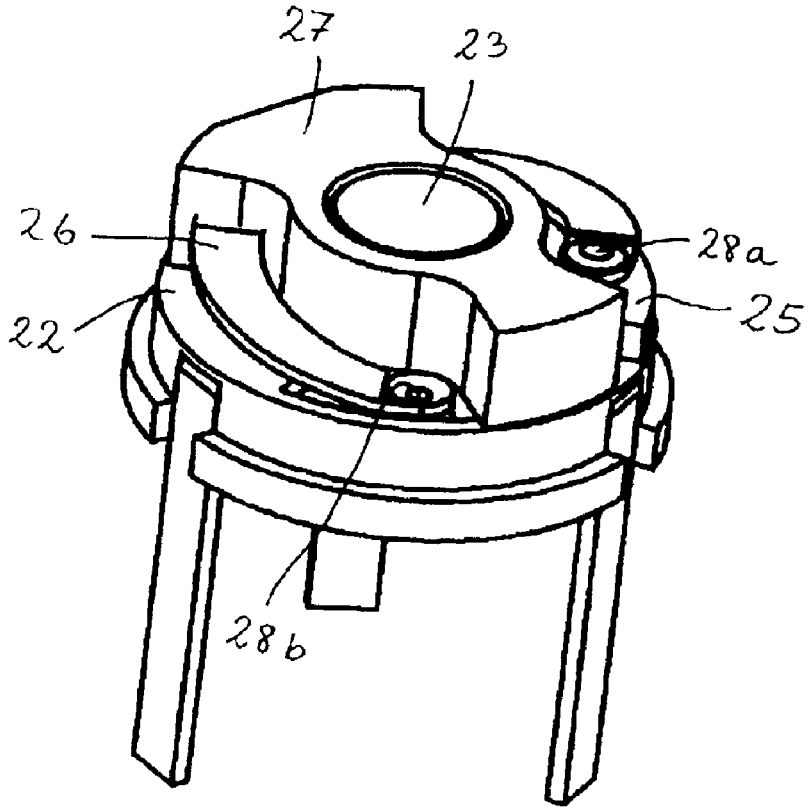

FIG. 11 shows the carrier member 27 mounted on top of the base part 22, so that the contact point 28*b* is in contact with one of the contact parts 21*b* or 21*c* through the hole 24. The rivet 23 is positioned in the hole of the carrier member 27.

Figure 12:
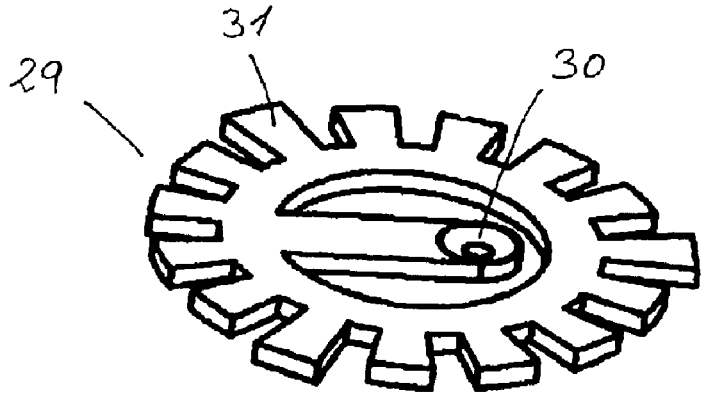

FIG. 12 shows an encoder disc 29 comprising a contact part 30 adapted to be in contact with the rivet 23 of FIG. 11, and a plurality of contact parts 31 adapted to be in contact with the contact point 28*a* of the wedge 26.

Figure 13:
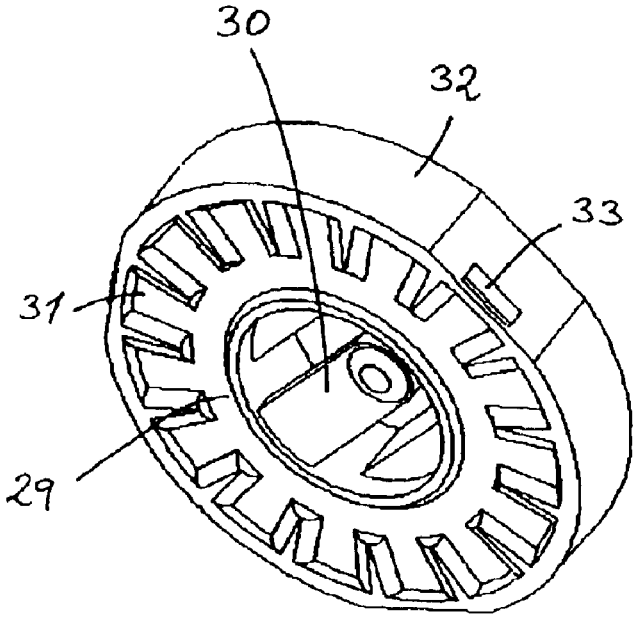

FIG. 13 shows the mounting of the encoder disc in a second carrier member 32. The disc is attached to the member 32 by three of the contact parts 31 having a portion 33 that protrudes the sidewall of the carrier member 32.

Figure 14:
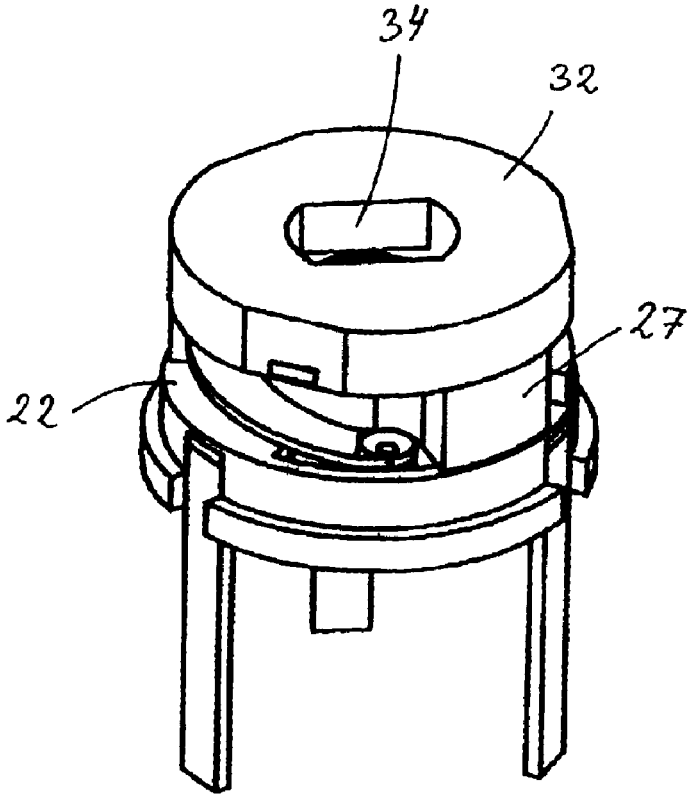

FIG. 14 shows the carrier member 32 mounted on top of the carrier member 27. The carrier member 32 comprises a hole 34 adapted to receive an attachment part of the user operable member of FIG. 15.

Figure 15:
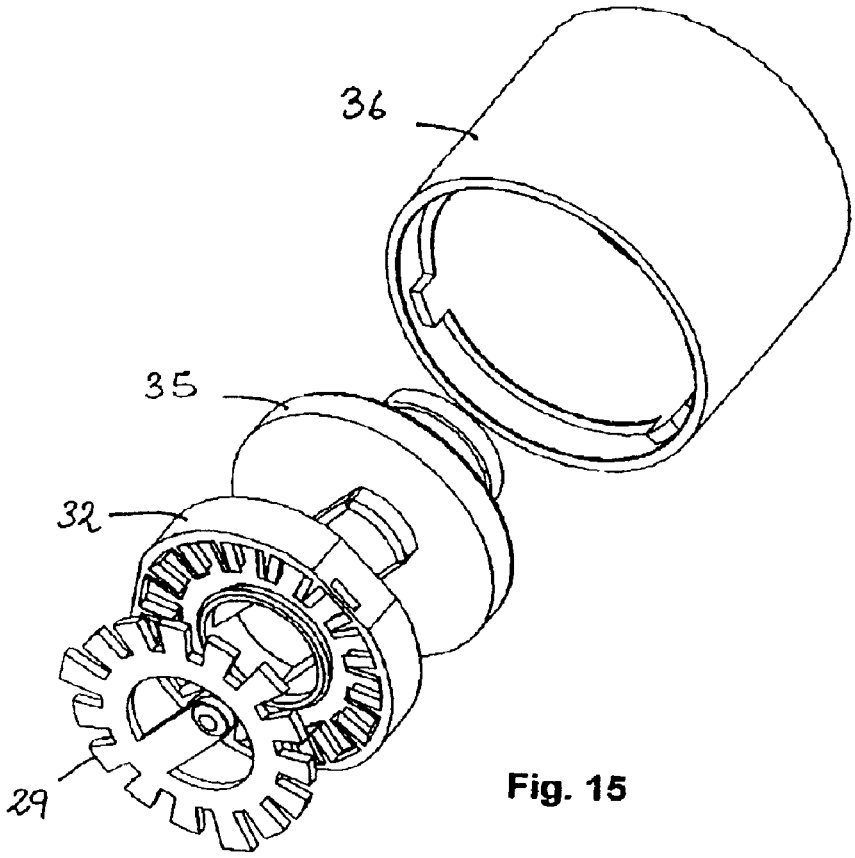
Figure 16:
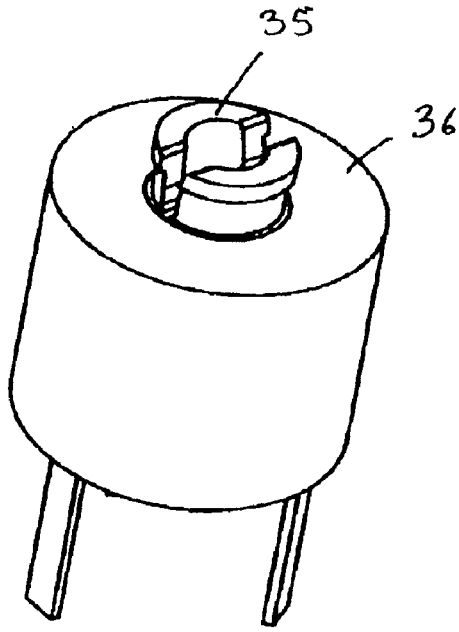
Figure 17:
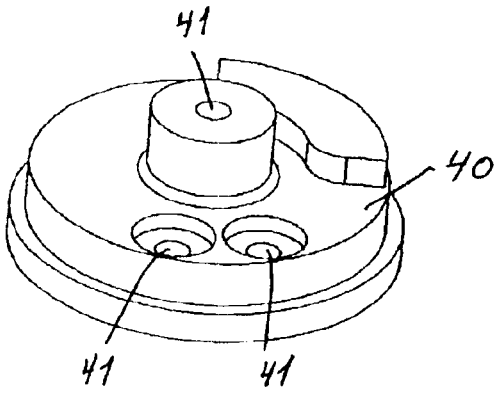
FIG. 17–23 shows a second embodiment of the assembly according to the second aspect of the present invention.
Figure 18:
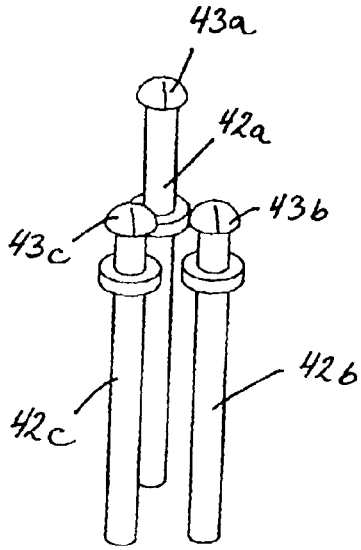
Figure 19:
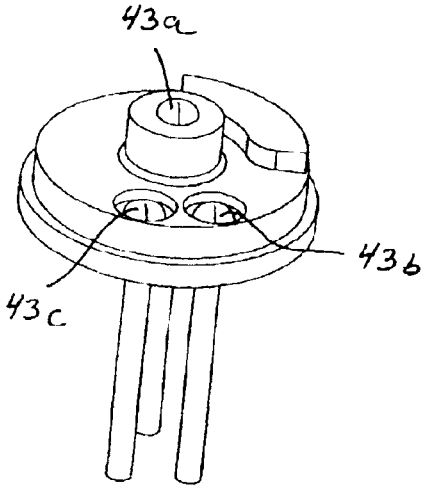

FIG. 15 is an exploded view of the upper parts of the assembly. The encoder disc 29 is mounted in the carrier member 32, which is meshed with a user operable member 35. A cover 36 is mounted onto the base part 22 (as seen in FIG. 16), so that the cover and base part together forms the housing. The user operable member 35 protrudes the cover, so as to allow an operator to rotate it.

Figure 20:
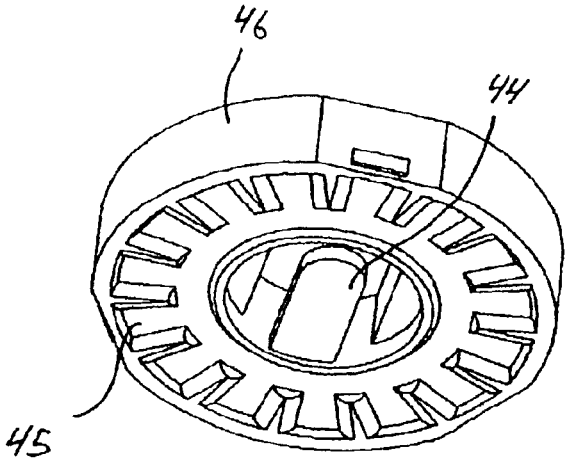
Figure 21:
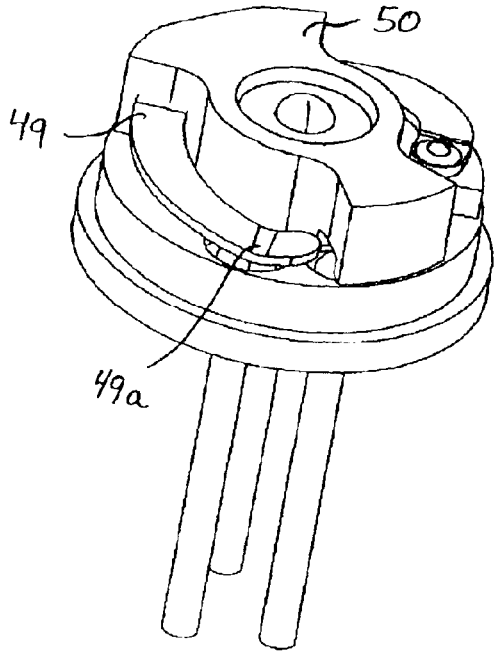
Figure 22:
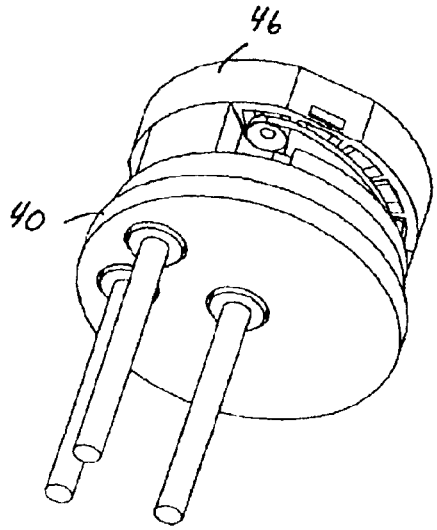

FIGS. 17–23 shows a second embodiment of the assembly according to the second aspect of the invention. The difference between the embodiment of FIGS. 7–16 and the embodiment of FIGS. 17–23 is that the latter comprises terminals 42*a*, 42*b*, 42*c* that are riveted to the base part 40 via holes 41. The contact surface/part of the terminals is then provided by the riveted part 43*a*, 43*b*, 43*c* of the terminals, respectively. As the contact surfaces are provided by the riveted part, the contact part 44 of the encoder disc 45 and the contact part 49*a* of the wedge 49 has a flat shape and not a contact point, as can be seen in FIGS. 20 and 21, respectively.

Figure 23:
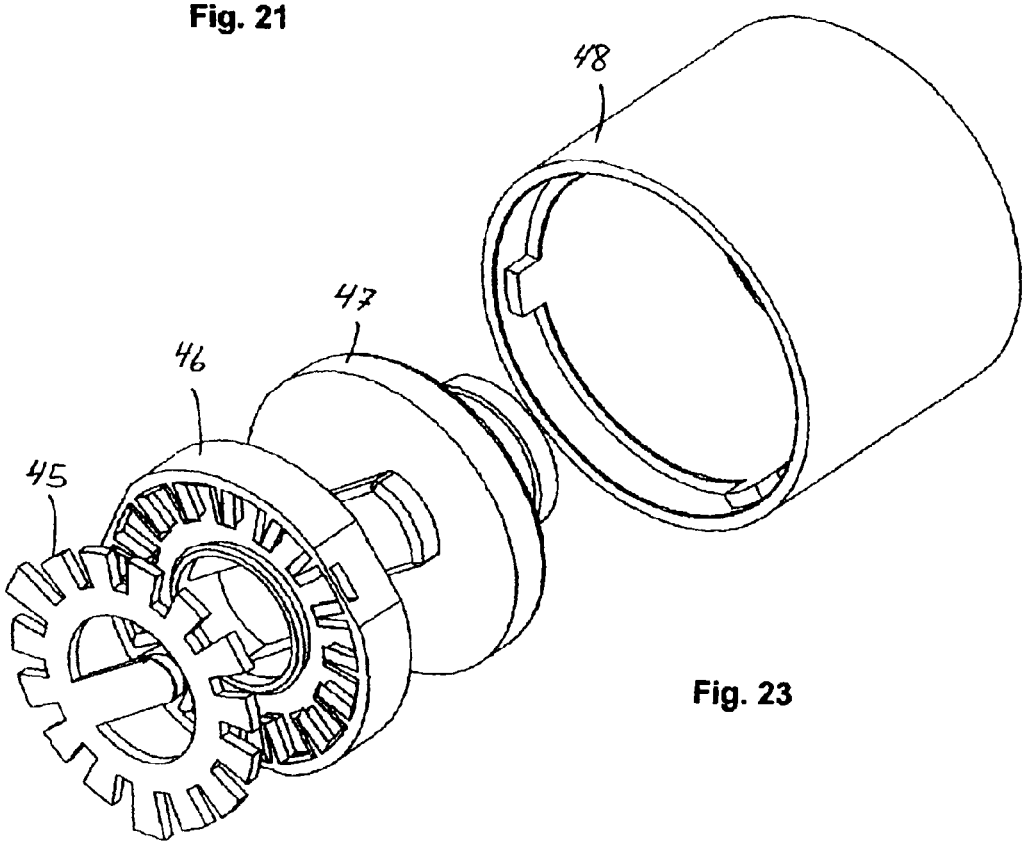

FIG. 23 shows an exploded view of the upper parts of the assembly. The encoder disc 45 is mounted in the carrier member 46, which is meshed with a user operable member 47. A cover 48 is mounted onto the base part 40, so that the cover and base part together forms the housing. The user operable member 47 protrudes the cover, so as to allow an operator to rotate it.

What is claimed is:

1. A digital pulse generator assembly, comprising:

a housing comprising a base part and a cover, at least a first, second and third external terminal, each external terminal protruding said base part and having a contact part inside said housing, the contact part of the first terminal being movable between at least two contact positions where it, in a first position, is in electrical contact with the second external terminal, and where it, in a second position, is in electrical contact with the third external terminal, and a wheel comprising spaced positioned cams, each cam being adapted to engage with the contact part of the first terminal and move the contact part of the first terminal to one its at least two contact positions upon rotation of said wheel, wherein said wheel is rotatable in a plane substantially perpendicular to the moving direction of the contact part of the first terminal when said contact part is moved between the at least two contact positions, and wherein the spaced positioned cams move the contact part of the first terminal into contact with the contact part of the second terminal upon clock-wise rotation of the wheel, and moves the contact part of the first terminal into contact with the contact part of the third terminal upon counter clock-wise rotation of the wheel.

2. A generator according to claim 1, wherein the contact part of the first terminal returns to a neutral position after disengagement with a cam.

3. A generator according to claim 1, wherein the wheel comprises a cylindrical hollowed wheel, and wherein the spaced positioned cams are provided circumferentially on its internal surface.

4. A generator according to claim 3, wherein the wheel comprises two sets of cams, a first set positioned at a first level and a second set positioned at a second level on the internal surface of the cylindrical wheel, the distance between the cams of the first set being different from the distance between the cams of the second set.

5. A generator according to claim 1, further comprising a user operable carrier wheel meshed with said wheel so as to rotate the wheel when rotating the carrier wheel, the carrier wheel having a user operable part protruding said cover.

6. A generator according to claim 5, wherein said wheel comprises recesses in its upper and/or lower edge for receiving projections of the carrier wheel so as to mesh the carrier wheel with the wheel.

7. A generator according to claim 1, wherein the contact part of each terminal comprises contact points so that the electrical contact between the respective contact parts is provided in one single point.

8. A generator according to claim 1, wherein an external diameter of the housing is equal to or less than 3 mm.

9. A generator according to claim 1, further comprising a fourth or fifth external terminal protruding said base part and having a contact part inside said housing.

10. A generator according to claim 1, wherein the base part comprises recesses to receive and hold the contact parts of the terminals.

11. A generator according to claim 1, wherein the contact parts of the terminals are elevated positioned in said base part, the contact part of the first terminal being positioned between the two other contact parts.

12. A generator according to claim 1, wherein the first terminal is connected to a ground or to a battery.

13. A hearing instrument comprising a generator according to claim 1.

14. A mobile device comprising a generator according to claim 1, the mobile device being a mobile phone, a PDA, or a portable game device.

15. A digital pulse generator assembly, comprising:

a housing comprising a base part and a cover, at least a first, second and third external terminal, each external terminal protruding said base part and having a contact part inside said housing, the contact part of the first terminal, being movable between at least two contact positions where it, in a first position, is in electrical contact with the second external terminal, and where it, in a second position, is in electrical contact with the third external terminal, and a wheel comprising spaced positioned cams, each cam being adapted to directly engage the contact part of the first terminal and move the contact part of the first terminal to one of its at least two contact positions upon rotation of said wheel, and wherein each cam is capable of moving the contact part of the first terminal into contact with the contact part of the second terminal upon clock-wise rotation of the wheel, and moving the contact part of the first terminal into contact with the contact part of the third terminal upon counter clock-wise rotation of the wheel.

16. A generator according to claim 15, wherein the contact part of the first terminal returns to a neutral position after disengagement with a cam.

17. A generator according to claim 15, wherein the wheel comprises a cylindrical hollowed wheel, and wherein the spaced positioned cams are provided circumferentially on its internal surface.

18. A generator according to claim 17, wherein the wheel comprises two sets of cams, a first set positioned at a first level and a second set positioned at a second level on the internal surface of the cylindrical wheel, the distance between the cams of the first set being different from the distance between the cams of the second set.

19. A generator according to claim 15, further comprising a user operable carrier wheel meshed with said wheel so as to rotate the wheel when rotating the carrier wheel, the carrier wheel having a user operable part protruding said cover.

20. A generator according to claim 15, wherein the contact part of each terminal comprises contact points so that the electrical contact between the respective contact parts is provided in one single point.

21. A generator according to claim 15, wherein the external diameter of the housing is equal to or less than 3 mm.

22. A mobile device comprising a generator according to claim 15, the mobile device being a mobile phone, a PDA, or a portable game device.

23. A hearing instrument comprising a generator according to claim 15.

* * * * *